US009499005B2

(12) United States Patent
Wormwood

(10) Patent No.: US 9,499,005 B2
(45) Date of Patent: Nov. 22, 2016

(54) SHEET MUSIC AND PAMPHLET ADAPTER CLIP

(76) Inventor: Alston Ray Wormwood, Standish, ME (US)

( * ) Notice: Subject to any disclaimer, the term of this patent is extended or adjusted under 35 U.S.C. 154(b) by 813 days.

(21) Appl. No.: 12/925,719

(22) Filed: Oct. 28, 2010

(65) Prior Publication Data

US 2011/0109075 A1 May 12, 2011

Related U.S. Application Data

(60) Provisional application No. 61/280,691, filed on Nov. 9, 2009.

(51) Int. Cl.

| | |
|---|---|
| ***B42D 3/00*** | (2006.01) |
| ***B42D 7/00*** | (2006.01) |
| ***B42D 19/00*** | (2006.01) |
| ***B42D 1/00*** | (2006.01) |
| ***B42D 5/00*** | (2006.01) |
| ***B42D 17/00*** | (2006.01) |

(52) U.S. Cl.
CPC ..... *B42D 17/005* (2013.01)

(58) Field of Classification Search
CPC ..... A47F 5/01; A47F 7/143
USPC ..... 281/7, 9, 10, 12, 15.1, 45, 46, 47; 211/45, 50, 181.1; 248/300–307, 248/316.7, 339, 451
See application file for complete search history.

(56) References Cited

U.S. PATENT DOCUMENTS

| | | | | |
|---|---|---|---|---|
| 71,703 | A | 3/1867 | Clarke | |
| 2,079,865 | A * | 5/1937 | Madle | 281/46 |
| 3,095,624 | A * | 7/1963 | Croisant | 24/67.9 |
| 3,349,597 | A * | 10/1967 | Gross, Jr. | 72/286 |
| 4,645,237 | A * | 2/1987 | Squire et al. | 281/47 |
| 6,254,135 | B1 | 7/2001 | Girard | 281/21.1 |
| 6,305,432 | B1 * | 10/2001 | Sacks et al. | 140/107 |

* cited by examiner

*Primary Examiner* — Moshe Wilensky
*Assistant Examiner* — Justin V Lewis
(74) *Attorney, Agent, or Firm* — Nils Peter Mickelson

(57) ABSTRACT

An adapter for holding folded sheet music, cards or the like in ring binders without the need to punch holes or otherwise modify the music. The adapter is in the form of a wire clip that can be pre-attached to, and retained on, the music before the music is mounted in the binder, allowing fast changes of arrangements within the binder.

7 Claims, 2 Drawing Sheets

Fig. 4
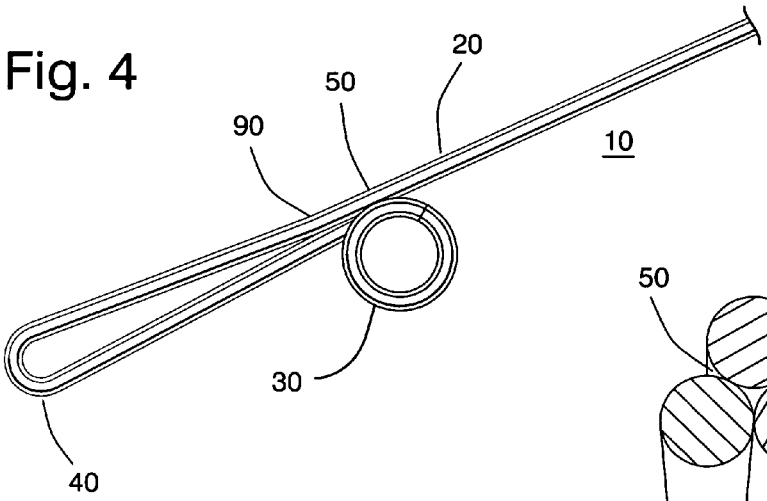
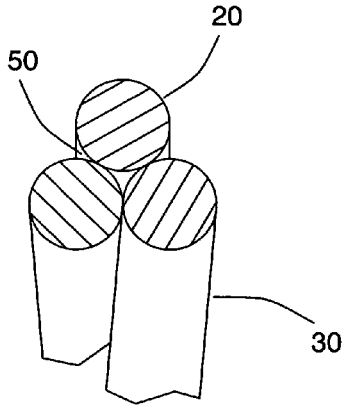
Fig. 5
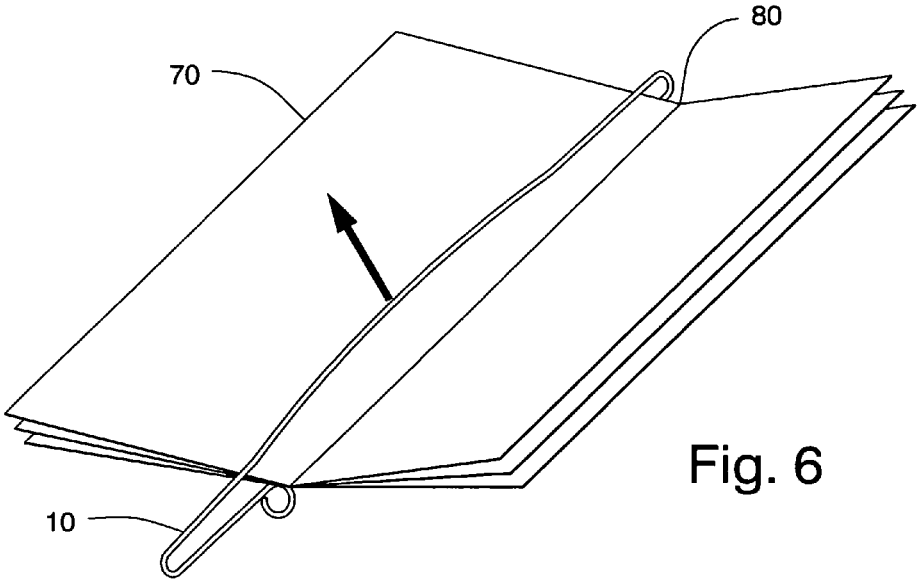
Fig. 6

SHEET MUSIC AND PAMPHLET ADAPTER CLIP

CROSS-REFERENCE TO RELATED APPLICATIONS

61/280,691 filed 2009 Nov. 9

STATEMENT REGARDING FEDERALLY SPONSORED RESEARCH OR DEVELOPMENT

Not Applicable

BACKGROUND OF THE INVENTION

Field of the Invention

This invention relates to the field of ring binders and adapters for same.

Background Art

Choral music, such as used by choirs and choruses, consists of sheets folded in the middle. The music could consist of one sheet or multiple sheets folded and assembled at the fold. Those comprising more than one sheet are often stapled along the fold. Such music is frequently held in binders or folders that can hold several selections of music, each of which can be opened, selection by selection and page by page as it is sung. A common three-ring binder is often used for holding the music, and that works well when the music has been punched with three holes. However, some organizations do not permit their music to be punched, especially those selections borrowed from other choral groups or music libraries. In these cases a separate adapter is required to hold the music to the three rings, or a folder other than a three-ring binder is used, leaving the music free to slide out during a concert.

One common adapter used to hold music in a typical three-ring binder is made from a narrow rectangle of thin plastic having three holes along one edge adjacent a long slot through which half the pages of the music may be slid, across to their fold. Either stapled or simply folded music is used with this adapter in the same manner, and the adapter works well for storage or general use, but is somewhat inadequate when the music is being presented in concert. Because this adapter does not clamp the music sheets within the slot it allows unstapled sheets of music to separate and become displaced from the fold. Misaligned folds hinder turning of the pages, a particular problem in music where sections of the score are repeated, requiring abrupt turning of pages backward and forward. Moreover, because the music is free to slide within the adapter slot, even the adapter itself can become misaligned with the fold line at the centerfold.

Similar problems exist with a metal wire adapter as taught by Squire et al. (U.S. Pat. No. 4,645,237), where a free-moving wire retainer is provided for each selection, but where again no provision is made to prevent slipping of sheets out from within the retainer.

There are also purpose-built music holding folders, having means incorporated to serve the same objectives as above. Some of them work well but have shortcomings either because the material they use makes them expensive or has a relatively short service life. Others are not easy to use and do not lend themselves well to changing the order of the music, especially when the change needs to be made in a hurry. Still others are limited by the number of musical selections they can hold. Examples include Clarke (U.S. Pat. No. 71,703) and Girard (U.S. Pat. No. 6,254,135) where a parallel series of elastic strands are employed, each strand to rest within the fold, yet each adjacent strand obstructing the free rotation of sheets that is normally necessary.

BRIEF SUMMARY OF THE INVENTION

This invention is an improved binder adapter for use in ring binders, one such adapter used for each selection, and each such adapter providing a clamping force against the selection sheets to prevent them from slipping out of place. Each adapter may be preferably formed from a single piece of continuous wire.

BRIEF DESCRIPTION OF THE SEVERAL VIEWS OF THE DRAWINGS

FIG. 4 shows a magnified plan view of an alternate embodiment using extra coils in the closed ring.

FIG. 5 shows a cross-sectional view of the pinch point in FIG. 4.

FIG. 6 shows a perspective view of the adapter clip being loaded.

DETAILED DESCRIPTION OF THE INVENTION

Figure 1:
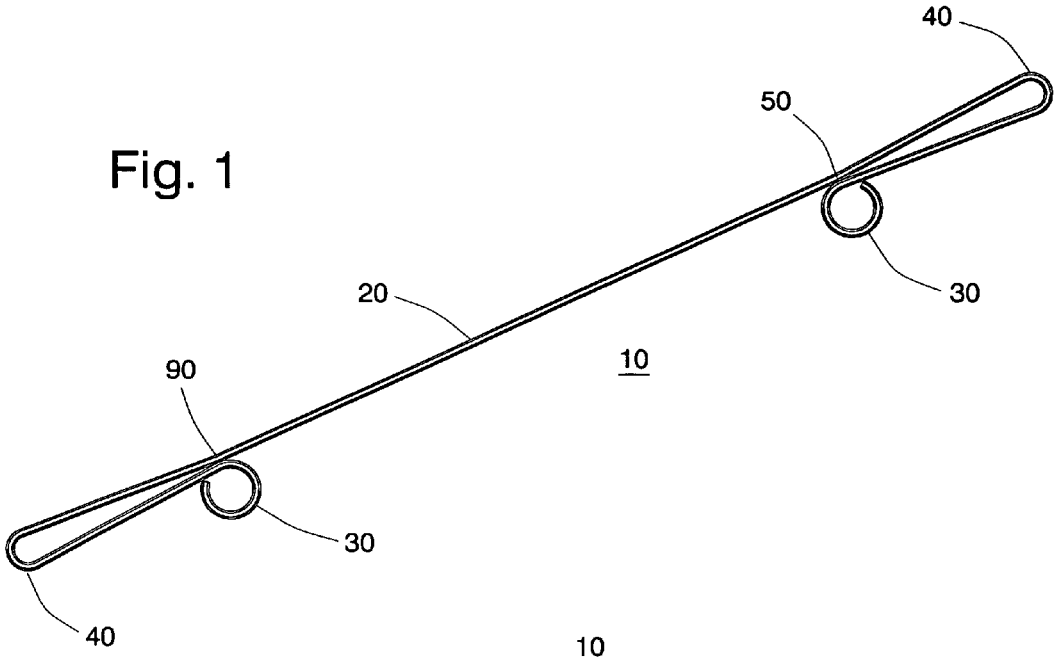
FIG. 1 is a plan view of the adapter clip, showing its two rings for placement in a ring binder and its two clamping or pinch points for retaining folded sheet music against slippage.

As most simply shown in FIG. 1, the adapter clip 10 comprises a straight length 20 of thin resilient material, such as spring wire, formed with a closed ring 30 at each extreme end and folded back into a loop 40 at a selected distance in from each end, such that a residual clamping force is attained at a pinch point 50 between each end loop 40 and the straight length 20.

The center-to-center distance between the two closed rings 30 is selected to match the distance between end rings in the binder, and the adapter clip's overall length is selected to be greater than the page height of the sheet music or pamphlet envisaged.

In its simplest embodiment, the adapter clip 10 is formed entirely from wire of a circular cross section, and entirely in only two dimensions. In practice, however, simple modifications to this form can substantially improve its functionality.

For example, where two parallel round wires press against one another to form a clamp, there is a tendency for them to slip out of planar alignment and pass by one another. This tendency can be overcome by widening the contact point in some way, such that alignment becomes less critical.

Figure 2:
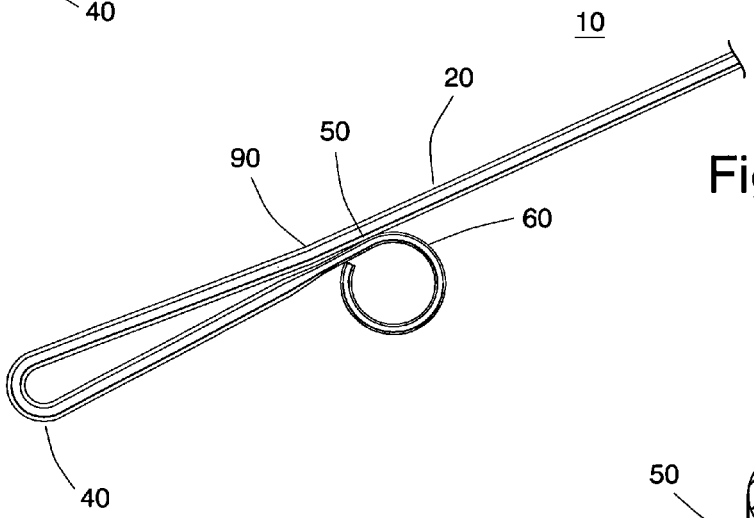
FIG. 2 shows a magnified plan view of a preferred embodiment using flattened wire.
Figure 3:
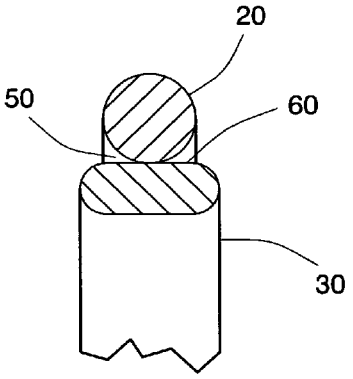
FIG. 3 shows a cross-sectional view of the pinch point in FIG. 2.

FIG. 2 shows one preferred way to accomplish this by locally flattening the round cross section to afford a flat surface 60, against which the parallel round cross section can bear without such sensitivity to misalignment. Similar results could be attained using wire of square or rectangular cross section. A detail of this type of widening is shown in FIG. 3.

FIG. 4 shows another widened configuration, wherein the end rings 30 are formed of more than one full coil, such that a paired couple of wires is presented to the opposing single-wire section at pinch point 50. In this case, the single wire tends toward remaining in the crevice between the other two. A detail of this manner of widening is shown in FIG. 5.

In practice, material choices and cross-section may be largely influenced by tooling methods and costs. Though envisaged herein as simply made from round steel spring wire, having sufficient plasticity to allow bending into shape yet a high enough yield strength to maintain its shape under normal use, one could as well use wire of square cross-section to obviate flattening, or use heat-treatment to harden the wire after forming, or use an alternative material such as a fiber-reinforced composite.

A preferred embodiment would also include counter-bends 90 in the straight length of the wire, at or immediately beyond each of the pinch points, to afford clearance between the clip and the inserted music where the music extends beyond the pinch point.

Using the adapter clip can be effected in several manners. In one way, a number of empty adapter clips can be pre-loaded into a three-ring binder. To install music on a clip, its folded sheets are first unfolded into their flat configuration. One clip is selected and gripped near the center of its straight length 20. Pulling outward, away from the binder, the straight length 20 bends elastically along its entire length so as to open the two pinch points 50. One edge of the opened music 70 is inserted through the open pinch points 50 and slid across until the fold line coincides with the pinch points. Releasing the straight length 20 relaxes the pinch points 50 so that they clamp the sheets along their fold line 80, after which the music can be re-folded around the clip 10 where it will retained until released, even if removed from the binder.

Another manner of use is to pre-load the adapter clip onto the music before inserting it into the binder. This method allows very quick re-arrangement of the music selections within the binder. Pre-loading is accomplished by sliding one the two pinch points 50 over an end of the fold line 80 of the music with the straight length along the inside of the fold, then flattening the music into its fully open position and buckling it across the fold line to permit sliding the free end of fold line 80 into the other pinch point 50. Closing the folded music presents a configuration that may be freely inserted or removed as a unit from the binder.

As can be seen from the above, this adapter clip can be used in many sizes of binders and with many sizes of paper, folded cards or pamphlet, and even used as a hanger for such articles. For various uses, it can be made from a variety of resilient materials and with a variety of cross-sections.

I claim:

1. An adapter clip for use in a ring binder or the like, adapted to hold without movement and retain in place folded sheet music within said ring binder without modification to said music, comprising a wireform of drawn round wire, said wireform having:

(a) a straight central portion of predetermined length, said straight predetermined length being equal to or greater than the height of said sheet music;

(b) a substantially U-shaped return bend at each end of said predetermined straight portion, each of said two bends being on the same side and in the same plane as one another, and each said bend having a predetermined bend radius;

(c) each said substantially U-shaped bend returning inwardly as a second straight portion of second predetermined length;

(d) each said second straight portion ending in a closed tangential ring coplanar with said substantially U-shaped bends, said closed rings looping away from said straight central portion;

(e) each of said two coplanar closed tangential rings having a diameter selected to fit freely onto the outermost two rings of said ring binder;

(f) each of said second predetermined lengths of said second straight portions selected to place said closed tangential coplanar rings equidistant with said two outermost rings of said ring binder, such that said wireform may be mounted on said two outermost rings of said binder and swung freely thereabout;

(g) each of said two substantially U-shaped bends having a bend angle of greater than 180 degrees, said greater bend angle selected to place each said closed tangential coplanar ring in forcible residual compressive contact against said straight central portion of said wireform, to provide thereby a pair of singular pinch points therebetween, whereby sheets of paper inserted through each of said two singular pinch points are held without movement and retained in position by said pinch points.

2. The adapter clip of claim 1 wherein each said closed tangential coplanar ring is a single closed coil formed entirely in a single plane of only two dimensions.

3. The adapter clip of claim 2 wherein a localized portion of said drawn round wire is flattened at each said pinch point to create thereby a larger bearing area for said single points of contact between each said closed ring and each said straight central portion.

4. The adapter clip of claim 1 wherein said closed tangential ring is a closed helix of slightly greater than one coil to create thereby an adjacent pair of round wire coils bearing against said straight central portion of drawn round wire, and thus a pair of adjacent point contacts at each of said two pinch points.

5. The adapter clip of claim 1 wherein a pair of counter-bends is introduced along said straight central portion of drawn round wire, each said counterbend placed proximate to and outboard of each said pinch point;

(a) said counterbends each being of a magnitude such that an imaginary extension line along said straight central portion of drawn round wire intersects the centerpoint of radius of each said substantially U-shaped bend, thus bisecting said bend angle of greater than 180 degrees;

providing thereby more free room for the top and bottom edges of said sheets of paper while said paper is being inserted within said adapter clip.

6. The adapter clip of claim 1 wherein said drawn wire is of square cross-section, causing thereby a linear line of contact at each said pinch point between the resulting straight central portion of drawn square wire and said closed tangential coplanar rings of said drawn square wire.

7. A method for holding folded sheet paper of single or multiple sheets in a snap ring binder comprising the steps of:

(a) opening the snap rings of said binder;

(b) mounting onto two of said snap rings the two said closed tangential coplanar rings of said adapter clip of claim 1;

(c) closing said two snap rings to retain thereon said two closed rings of said adapter clip, and thereby retaining said adapter clip within said ring binder;

(d) lifting away from said ring binder said straight central portion of said adapter clip such that said residual compressive contact at said two pinch points is overcome, and said pinch points are thereby held open for insertion of said paper sheets;

(e) opening said folded paper sheets at their fold into a flat unfolded form;

(f) sliding an edge of said paper sheets under said lifted straight central portion of said adapter clip and over said two closed rings of said adapter clip until said fold aligns directly beneath said straight portion and directly above said pinch points;

(g) releasing said straight central portion to allow said residual compressive contact to be restored, thereby both holding and retaining said sheets along said fold; and finally (h) folding said sheets together around said straight length portion into their original folded form, whereby said adapter clip holds and retains said folded sheets as a coordinated unit within said binder, yet allows said folded unit with its adapter clip to slide freely around said closed binder snap rings without any need for holes or other modifications being made to said folded sheets;

affords free turning of pages within said folded unit of sheets, backwardly and forwardly, without causing misalignment or obstruction of said turning;

allows any unit of folded sheets with its adapter clip to be removed as a unit from, moved into a new location around, and again retained upon said snap rings for serial rearrangement among a series of such folded units; and allows removal of such sheets as a unit from their adapter clip by reversal of the above process, affording no harm to said sheets at any time.

* * * * *